US006039609A

United States Patent [19]

Hauver, Sr. et al.

[11] Patent Number: 6,039,609

[45] **Date of Patent: *Mar. 21, 2000**

[54] POWER INSERTER CONNECTOR

[75] Inventors: Bruce C. Hauver, Sr.; Ronald P. Locati, both of Elmira, N.Y.; Larry Michael Massaglia, Crestline, Calif.

[73] Assignee: Thomas & Betts International, Inc., Sparks, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/783,398

[22] Filed: Jan. 13, 1997

Related U.S. Application Data

[60] Provisional application No. 60/021,926, Jul. 17, 1996.

[51] Int. Cl.[7] ..... H01R 17/18

[52] U.S. Cl. ..... 439/668; 439/675; 439/578

[58] Field of Search ..... 439/668, 578–585, 439/675, 814

[56] References Cited

U.S. PATENT DOCUMENTS

| | | | |
|---|---|---|---|
| 1,026,238 | 5/1912 | Andersen | 439/675 |
| 4,431,254 | 2/1984 | Cartesse | 439/675 |
| 4,854,893 | 8/1989 | Morris | 439/578 |
| 4,869,690 | 9/1989 | Frear et al. | 439/675 |
| 5,885,104 | 3/1999 | Foster et al. | 439/580 |
| 5,928,032 | 7/1999 | Dreesen | 439/578 |

FOREIGN PATENT DOCUMENTS

| | | | |
|---|---|---|---|
| 1003310 | 2/1957 | Germany | 439/668 |
| 0667537 | 9/1964 | Italy | 439/675 |

*Primary Examiner*—Paula Bradley
*Assistant Examiner*—Tho D. Ta
*Attorney, Agent, or Firm*—Weingarten, Schurgin, Gagnebin & Hayes LLP

[57] ABSTRACT

A coaxial shaped power inserter connector for a CATV (Cable Television) housing accepts two conductors at a first end. A first conductor, typically a power conductor, is secured to a center terminal which extends beyond the distal end of the connector body. A second conductor, typically a ground conductor, is secured to the body of the connector. The connector may be sealed or unsealed. The connector is useful for providing power to a CATV housing.

28 Claims, 7 Drawing Sheets

POWER INSERTER CONNECTOR

CROSS-REFERENCE TO RELATED APPLICATIONS

This application is based on Provisional Patent Application No. 60/021,926 filed on Jul. 17, 1996.

STATEMENT REGARDING FEDERALLY SPONSORED RESEARCH OR DEVELOPMENT

Not Applicable

BACKGROUND OF THE INVENTION

Cable television (CATV) housings receive power from a separate power cable which must be hard-wired to the internal electronics of a CATV housing. Such a setup requires disassembly of the housing in order to electrically and mechanically secure the power conductors within the housing. The CATV housing may be located outdoors such as at the top of a telephone pole or underground, making access to and disassembly of the housing more difficult. Such a process is time consuming, cumbersome and can result in installer induced problems.

BRIEF SUMMARY OF THE INVENTION

A power inserter connector is disclosed. The power inserter connector includes a body having a terminal which extends from within the first end of the power inserter connector body to beyond a second end thereof. The terminal is configured to receive a first conductor, typically a power conductor within the first end and includes a first seizure mechanism to secure the first conductor to the terminal. An insulator insulates the terminal from the connector body. A second seizure mechanism is used to secure a second conductor, typically a ground conductor, to the body of the connector. The connector may be sealed for weatherproof operation or unsealed if operating conditions do not require weatherproof sealing. The connector is used to conveniently provide power from a pair of conductors to a CATV housing.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
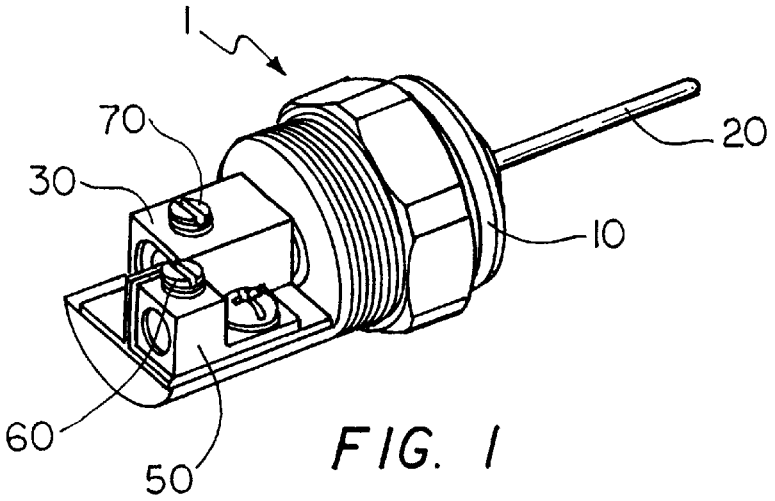
FIG. 1 is an isometric view of a power inserter connector of the present invention.
Figure 1A:
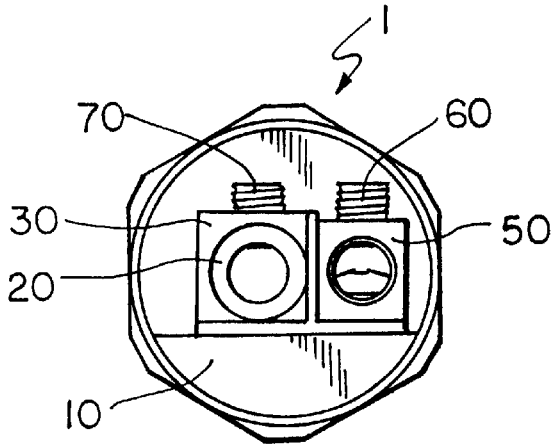
FIG. 1A is an end view of the power inserter connector of FIG. 1.
Figure 1B:
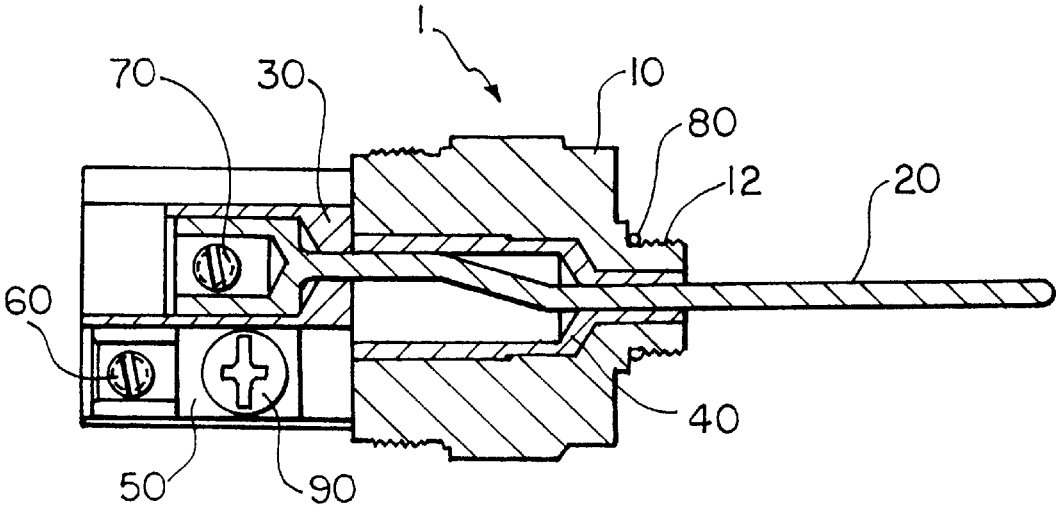
FIG. 1B is a cross-sectional view of the power inserter connector of FIG. 1.

FIGS. 1–1B show a power inserter connector 1 according to the present invention. The power inserter connector 1 comprises a body 10, a first terminal 20 having a first seizure mechanism having a seizure screw 70 at a first end, a front insulator 40, a rear insulator 30 and a second terminal 50 which includes a second seizure mechanism having a seizure screw 60. In this embodiment the seizure mechanism includes a threaded bore 55 and a seizure screw 60 inserted within the threaded bore. Other embodiments may include other seizure mechanisms as would be known by those of reasonable skill in the art. The connector accepts a pair of conductors, one at each of the respective first and second terminals. Once the conductors have been installed and secured to their respective terminals, the end of the connector is wrapped with tape or covered with heat shrink tubing to insulate the terminals from unintended contact.

Figure 2A:
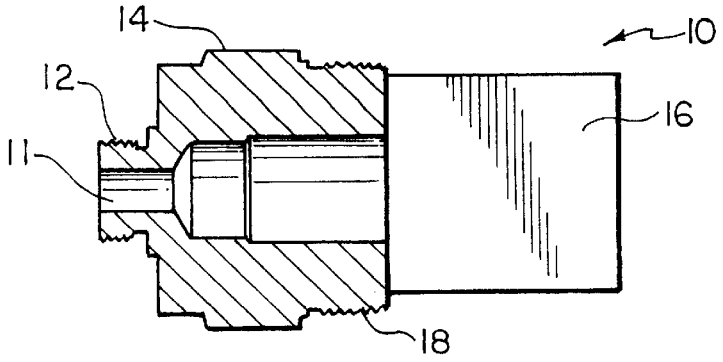
FIG. 2A is a cross-sectional view of the body of FIG. 2.
Figure 2B:
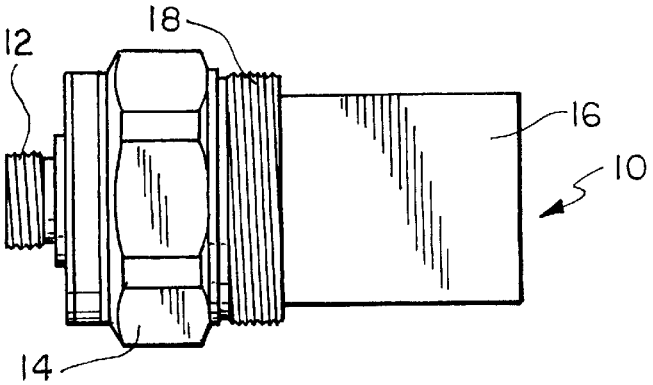
FIG. 2B is a top view of the body of FIG. 2.
Figure 2:
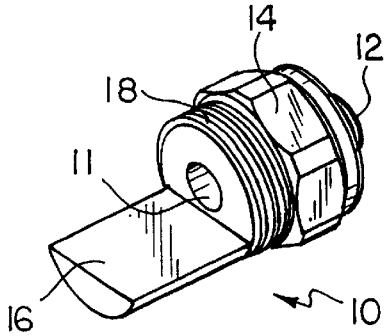
FIG. 2 is an isometric view of the body of the power inserter connector of FIG. 1.

FIGS. 2–2B show power inserter connector body 10. Body 10 is comprised of aluminum or other corrosion resistant material. A first end of the body 10 includes a threaded section 12 which is configured to mate with a cooperating CATV power inserter housing (not shown). A center section 14 is hexagonally shaped in order to provide a surface that allows for sufficient tightening of first end 12 to the CATV power inserter housing. A central bore 11 extends through body 10. Threaded section 18 is provided adjacent hexagonally shaped center section 14 and allows for removal of center section 14. A semi-circular portion 16 having a flat upper surface comprises the second end of body 10. The flat surface is useful for supporting the first terminal, the second terminal, and the rear insulator as will be described in detail below.

Figure 3:
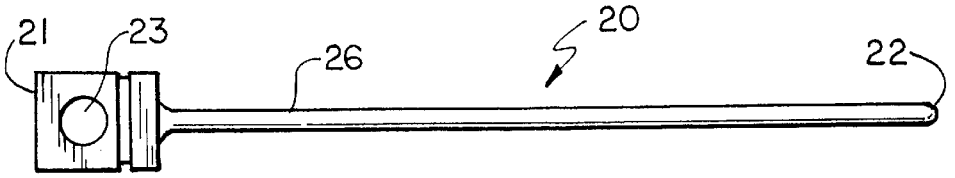
FIG. 3 is a top view of a first terminal.
Figure 3A:
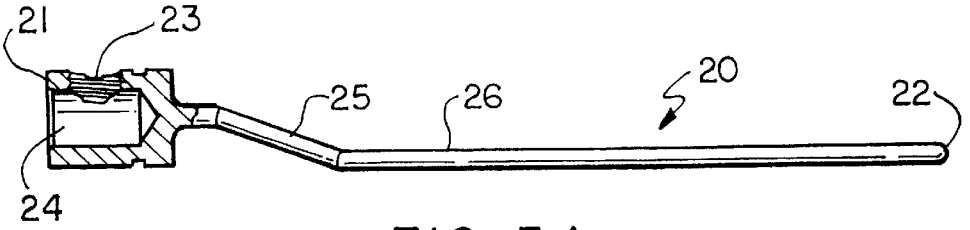
FIG. 3A is a cross-sectional side view of the terminal of FIG. 3.

FIGS. 3–3A show first terminal 20, which is comprised of tin-plated brass or other conductive material. The terminal 20 has a rectangular shaped first end 21 which includes an opening 23, in this embodiment a threaded bore, which is part of a first seizure mechanism. In other embodiments other seizure mechanisms which are known to those skilled in the art may be utilized. A second bore 24 extends centrally into the first end 21 and is configured to receive a first conductor (not shown) therein. The first conductor comprises copper or aluminum and is sized from AWG #14 to AWG #2. If an aluminum conductor is used, an anti-oxidant compound should be applied to the conductor before it is secured within the terminal. The terminal 20 includes a long, solid cylindrical section 26 extending to the second end 22. The cylindrical section 26 has an angular section 25 which offsets the remaining portion of the cylindrical section 26 with respect to the first end 21. The terminal is configured to carry an electrical current of up to thirty amperes and a voltage of up to ninety volts. In this embodiment the second end of terminal 20 is rounded, however other embodiments could incorporate differently shaped ends.

Figure 4:
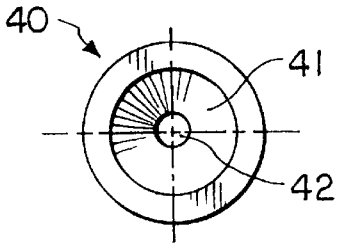
FIG. 4 is an end view of a front insulator.
Figure 4A:
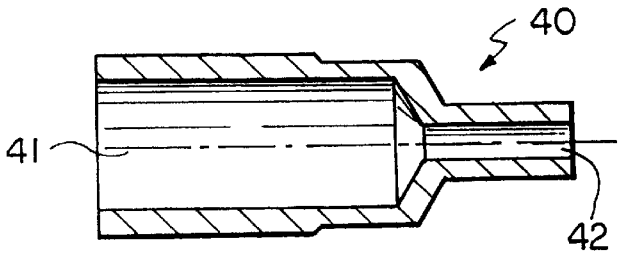
FIG. 4A is a cross-sectional side view of the front insulator of FIG. 4.

FIGS. 4–4A show front insulator 40. Front insulator 40 is comprised of nylon, DELRIN or other insulative material and includes a first bore 41 centrally disposed a predetermined distance within insulator 40. Second bore 42, smaller in diameter than first bore 41, extends from the end of first bore 41 through insulator 40. First bore 41 and second bore 42 are configured such that terminal cylindrical section 26 including angled section 25 are received therein and insulates that portion of terminal 20 from the power inserter connector body 10.

Figure 5:
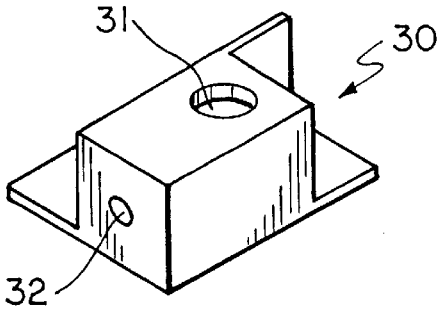
FIG. 5 is an isometric view of a rear insulator.
Figure 5A:
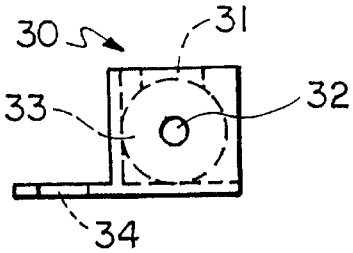
FIG. 5A is an end view of the rear insulator of FIG. 5.
Figure 5B:
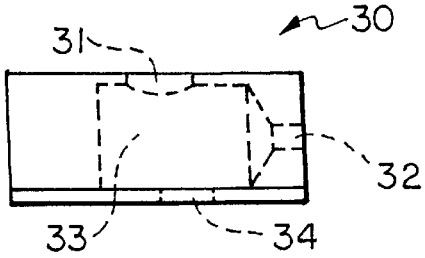
FIG. 5B is a side view of the rear insulator of FIG. 5.

FIGS. 5–5B show rear insulator 30. Rear insulator 30 is comprised of nylon, DELRIN or other insulative material and is configured to isolate the first end 21 of terminal 20 from the body 10 of the power inserter connector. Rear insulator 30 has a first bore 31 which is configured to allow a section of the first seizure mechanism to pass through. A second bore 33 extends a predetermined distance within the insulator 30 and is configured to receive and secure the first end 21 of terminal 20 therein. Third bore 32 extends from second bore 33 through the remaining section of the insulator and is configured to fit around a section of terminal 20. A fourth bore 34 allows for a mounting screw to pass therethrough and to secure the rear insulator 30 to the flat surface 16 of connector body 10.

Figure 6:
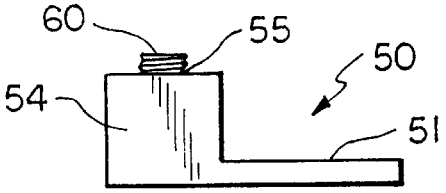
FIG. 6 is a side view of a second terminal.
Figure 6A:
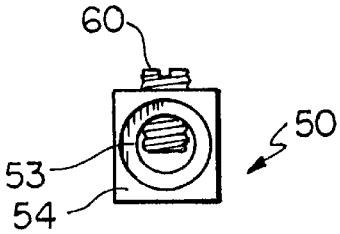
FIG. 6A is an end view of the second terminal of FIG. 6.
Figure 6B:
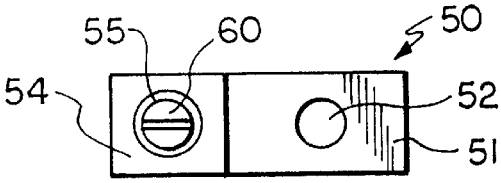
FIG. 6B is a top view of the second terminal of FIG. 6.

Referring now to FIGS. 6–6B, second terminal 50 is shown. Second terminal 50 is comprised of a tin plated aluminum alloy or other conductive material. Second terminal 50 includes a flat section 51 having a hole 52 disposed therethrough for mounting the second terminal 50 within body 10. The second terminal 50 further includes a rectangular section 54 having a first bore 55 for receiving a seizure screw 60. A second bore 53 extends into section 54 and is configured to receive a second conductor (not shown) therein, the second conductor being secured within the second bore 53 by seizure screw 60. The second conductor comprises copper or aluminum and is sized from AWG #14 to AWG #2. If an aluminum conductor is used, an anti-oxidant compound should be applied to the conductor before it is secured within the terminal 50. Other embodiments may implement other seizure mechanisms as would be known by those skilled in the art.

The power inserter connector 1 is assembled as follows. O-ring 80 is lubricated and installed adjacent the threaded section 12 of body 10. Front insulator 40 is installed within body 10. Anti-oxidant compound is applied to the threads of mounting screw 90 and the mounting portions of second terminal 50. Screw 90 is placed through second terminal 50, through rear insulator 30 and into body 10. Terminal 20 is then inserted through the front and rear insulators. Mounting screw 90 is tightened, securing first terminal 20, second terminal 50 and rear insulator 30 to body 10. Seizure screws 70 and 60 are installed into terminals 20 and 50 respectively.

The power inserter connector 1 is installed into the power inserter housing as follows. Anti-oxidant joint compound is applied to the threaded section 12 of body 10. The power inserter body 10 is installed onto the power inserter housing. Nut section 14 is removed and placed over the conductors. Approximately ½ inch of cable jacket is removed from the conductors. A conductor, typically the neutral conductor, is inserted into bore 53 of second terminal 50. Seizure screw 60 is tightened, securing the conductor to the second terminal 50. Another conductor, typically the hot conductor, is inserted into bore 24 of terminal 20. Seizure screw 70 is tightened, securing the hot conductor to the terminal 20. Nut section 140 is installed on body 10 and tightened. Heat shrink tubing or insulative tape is installed over the exposed end of the connector body 10.

The power inserter connector 1 is disconnected as follows. The heat shrink tubing or tape is removed. The mounting screw 90 is loosened. The seizure screws 60 and 70 are loosened, and the conductors removed from the terminals. The power inserter connector 1 is then removed from the CATV power inserter housing.

Figure 7:
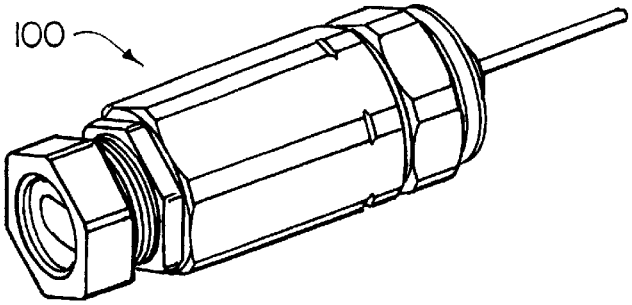
FIG. 7 is an isometric view of a waterproof power inserter connector of the present invention.
Figure 7A:
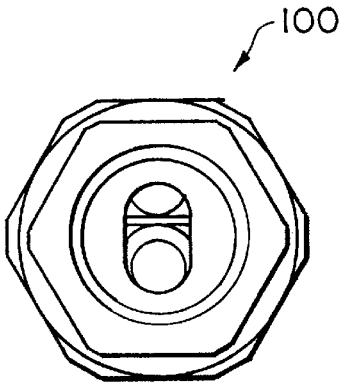
FIG. 7A is an end view of the waterproof power inserter connector of FIG. 7.
Figure 7B:
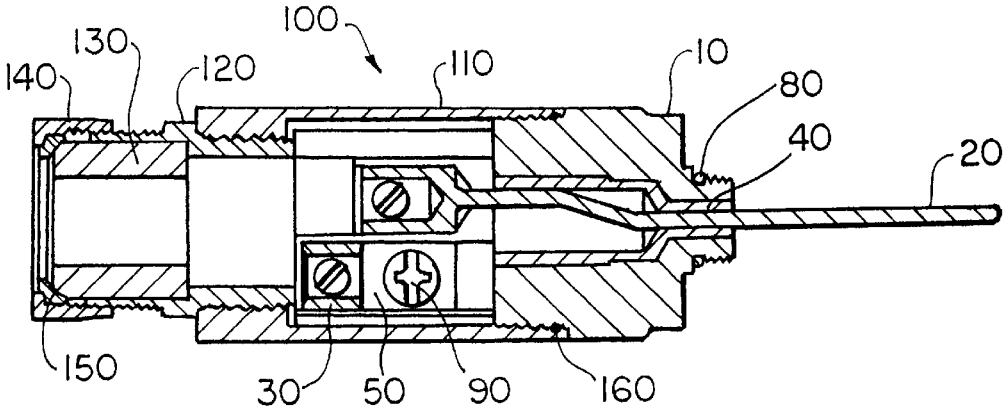
FIG. 7B is a first cross-sectional view of the waterproof power inserter connector of FIG. 7.
Figure 7C:
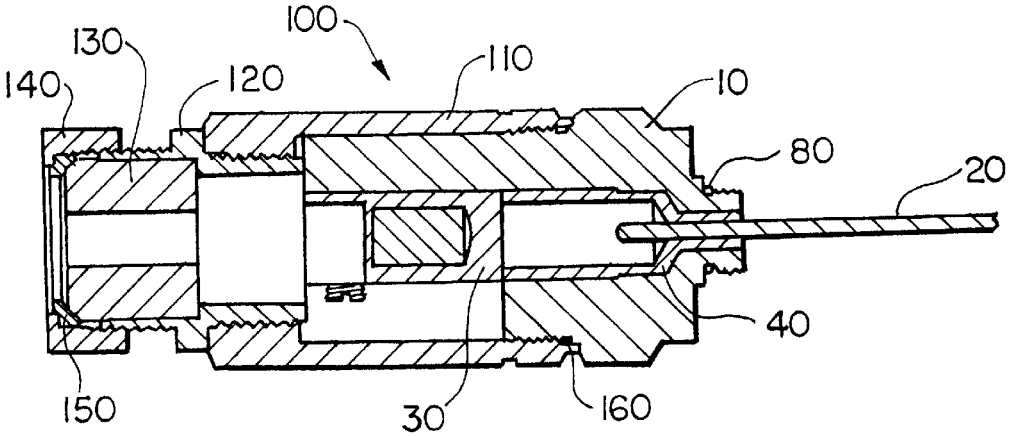
FIG. 7C is a second cross-sectional view of the waterproof power inserter connector of FIG. 7.

A second embodiment of a power inserter connector is shown in FIGS. 7–7C. In this embodiment the power inserter connector 100 is waterproof. This embodiment 100 is similar to power inserter connector 1 with the addition of a subassembly insert 120, a seal 130, an o-ring 160, a sealing ring 150 and a sealing nut 140.

Figure 8:
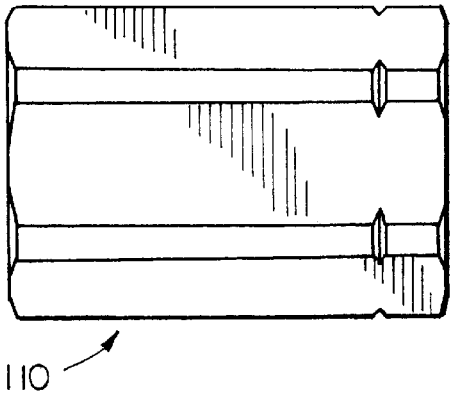
FIG. 8 is a side view of a subassembly body.
Figure 8A:
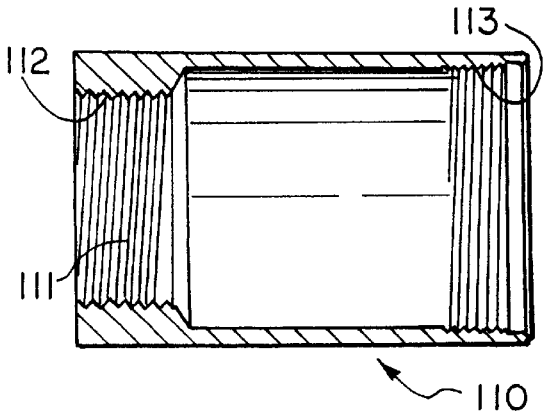
FIG. 8A is a cross-sectional side view of the subassembly body of FIG. 8.

FIGS. 8–8A show subassembly body 110. Subassembly body 110 is comprised of aluminum or other noncorrosive material and includes a central bore 111 extending therethrough. A first plurality of threads 112 are disposed about the interior surface of bore 111 adjacent a first end of the subassembly body 110. A second plurality of threads 113 are disposed about the interior surface of bore 111 adjacent a second end of the subassembly body 110. The second end of subassembly body 110 is configured to mate with a cooperating section of body 10.

Figure 9:
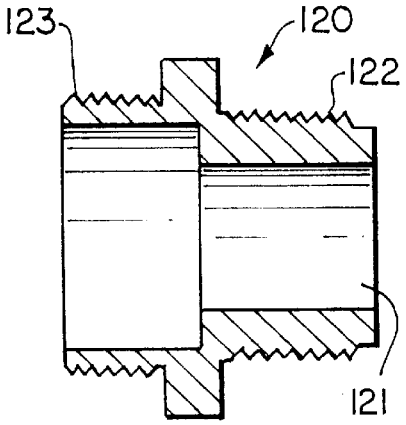
FIG. 9 is a cross-sectional side view of a subassembly insert.

Referring now to FIG. 9, the subassembly insert 120 is shown. Insert 120 is comprised of aluminum or other corrosion resistant material. A bore 121 is centrally disposed through insert 120. A first plurality of threads 122 are disposed about an external surface adjacent the first end of insert 120. A second plurality of threads 123 are disposed about an external surface of the insert adjacent the second end. The first plurality of threads are configured to mate with the second end of sub-assembly body 110.

Figure 10:
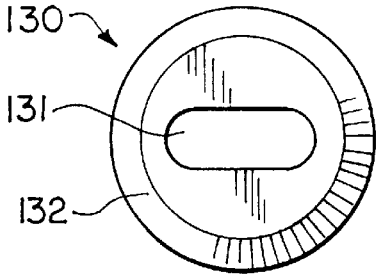
FIG. 10 is an end view of a seal.
Figure 10A:
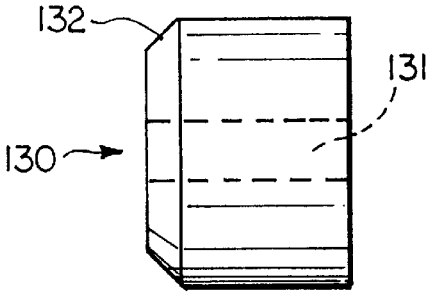
FIG. 10A is a side view of the seal of FIG. 10.

FIGS. 10–10A show seal 130. Seal 130 is comprised of neoprene or other material capable of providing a waterproof seal. Seal 130 is cylindrical in shape and includes a bore 131 disposed therethrough which has an oval cross-sectional shape. Seal 130 also includes a beveled edge 132 about the first end thereof. Bore 131 is configured to securely receive a conductor pair therethrough and to provide a waterproof seal about the conductor pair. A first end of seal 130 is configured to fit inside the second end of insert 120.

Figure 11:
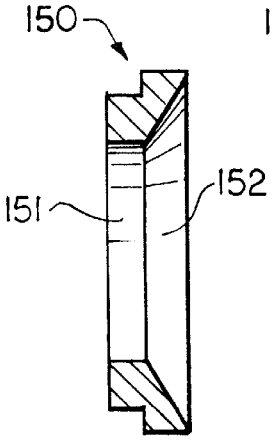
FIG. 11 is a cross-sectional side view of a sealing ring.
Figure 12:
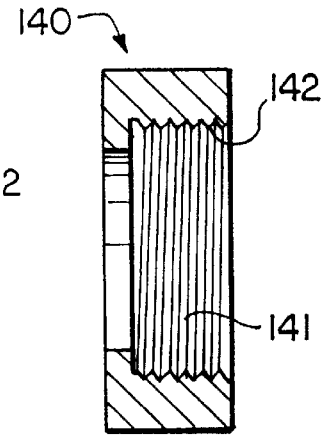
FIG. 12 is a cross-sectional side view of a sealing nut.

Sealing ring 150 is shown in FIG. 11. Sealing ring 150 is comprised of aluminum or other corrosion resistant material. Ring 150 includes a central bore 151 disposed therethrough. A first end of the central bore 151 includes a tapered end 152. The tapered end 152 is configured to align with the tapered end of seal 130 when the ring is positioned abutting the second end of insert 120. FIG. 12 shows sealing nut 140. Nut 140 is comprised of die cast zinc or other corrosion resistant material. Nut 140 includes a central bore 141 disposed therethrough and contains a plurality of threads 142 disposed along an interior surface adjacent the first end of nut 140. Nut 140 is configured to mate with the second end of insert 120 and to secure seal 130 and sealing ring 150 therein, thereby providing a waterproof interface at the entrance of the conductors to the power inserter connector.

The power inserter connector 100 is assembled as follows. O-ring 80 is lubricated and installed adjacent the threaded section 12 of body 10 and o-ring 160 is lubricated and installed adjacent the threaded section 18 of body 10. Front insulator 40 is then installed within body 10. Anti-oxidant compound is applied to the threads of screw 90 and the mounting portions of second terminal 50. Screw 90 is placed through second terminal 50, through rear insulator 30 and into body 10. Terminal 20 is then inserted through the front and rear insulators. Mounting screw 90 is tightened, securing terminal 20, terminal 50 and rear insulator 30 to body 10. Seizure screws 70 and 60 are installed into terminals 20 and 50 respectively. Subassembly body 110 is mated with body 10, subassembly insert 120 is mated with subassembly body 110, seal 130 is installed into the end of subassembly insert 120, sealing ring 150 is installed adjacent the end of seal 130 and sealing nut 140 is mated with insert 120.

The power inserter connector 100 is installed into the power inserter housing as follows. Anti-oxidant joint compound is applied to the threaded section 12 of body 10. The power inserter body 10 is installed onto the power inserter housing. The subassembly body 110, including inset 120, seal 130, sealing ring 150 and sealing nut 140 are removed from the connector and placed over the conductors. Approximately ½ inch of cable jacket is removed from the conductors. If aluminum conductors are used, anti-oxidant joint compound should be applied to the exposed conductors. A conductor, typically the neutral conductor, is inserted into bore 53 of second terminal 50. Seizure screw 60 is tightened, securing the conductor to the second terminal 50. Another conductor, typically the hot conductor, is inserted into bore 24 of terminal 20. Seizure screw 70 is tightened, securing the hot conductor to the terminal 20. The subassembly body 110, including the subassembly insert 120, seal 130, sealing ring 150 and sealing nut 140 are mated with the connector body 10. Subassembly body is tightened to connector body 10. Sealing nut 140 is tightened until the seal is fully compressed against the conductors jackets.

The power inserter connector 110 is disconnected as follows. The sealing nut 140 is loosened, then the subassembly body 110 is loosened from the connector body 10. The mounting screw 90 is loosened. The seizure screws 60 and 70 are loosened, and the conductors removed from the terminals 20 and 30. The power inserter connector 110 is removed from the power inserter housing.

Figure 13:
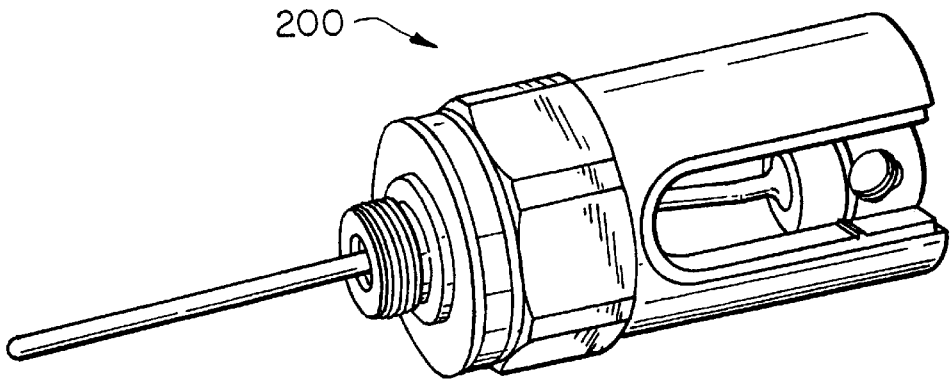
FIG. 13 is a first isometric view of an embodiment of the power inserter connector of the present invention.
Figure 13A:
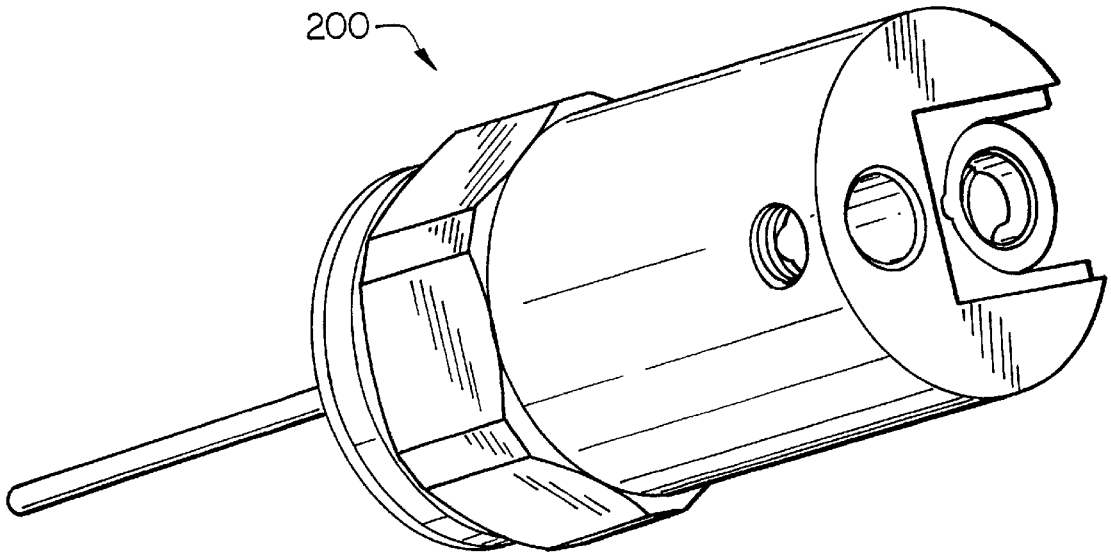
FIG. 13A is a second isometric view of the power inserter connector of FIG. 13.
Figure 13B:
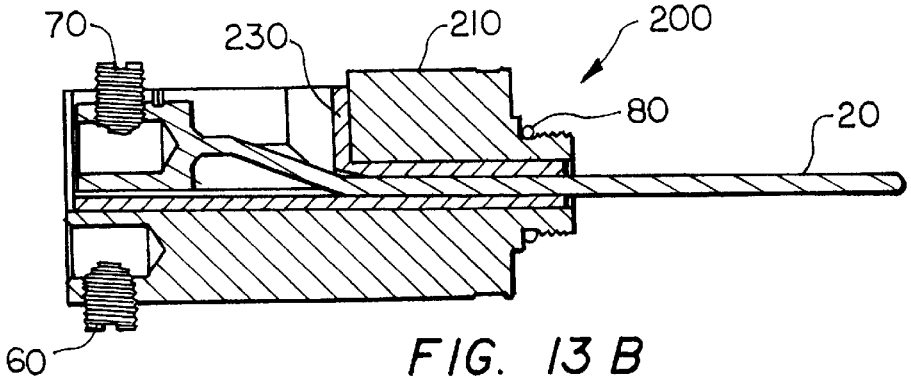
FIG. 13B is a cross-sectional side view of the power inserter connector of FIG. 13.

FIGS. 13–13B show another embodiment of a power inserter connector 200. The same style terminal 20 is used as is used with the other embodiments 1 and 100 described above. A single insulator 230 is utilized to isolate terminal 20 from body 210. Body 210 includes an integral seizure mechanism 260 for securing a second conductor to the body 210, thus a second terminal is not required, reducing the parts count and making the connector lower in cost and assembly time.

Figure 14:
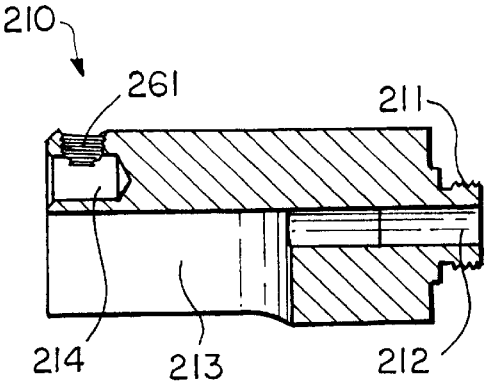
FIG. 14 is a cross-sectional side view of the body of the power inserter connector of FIG. 13.
Figure 14A:
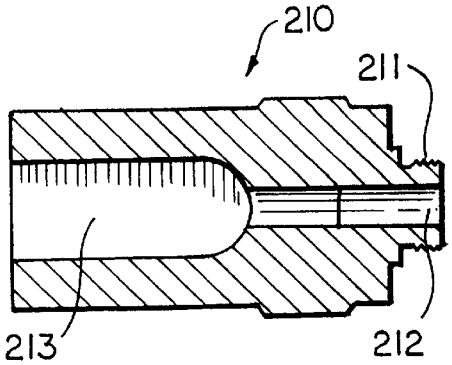
FIG. 14A is a cross-sectional top view power inserter connector body of FIG. 13.

Referring now to FIGS. 14–14A, the power inserter connector body 210 is shown. The body 210 is comprised of aluminum or other corrosion resistant material, and includes a threaded first end 211 for mating with a cooperating connector such as a CATV power inserter housing. A second end of the connector body 210 includes a cavity 213 for receiving the first end of terminal 20 and is configured to allow access to the seizure mechanism of terminal 20. A first central bore 212 extends from the cavity through the connector body. A second bore 214 is partially disposed within body 210 and is configured to receive a conductor therein. A seizure mechanism bore 261 is provided which allows the securement of the second conductor to the body when the conductor is inserted within bore 214 and seized by seizure mechanism 260.

Figure 15:
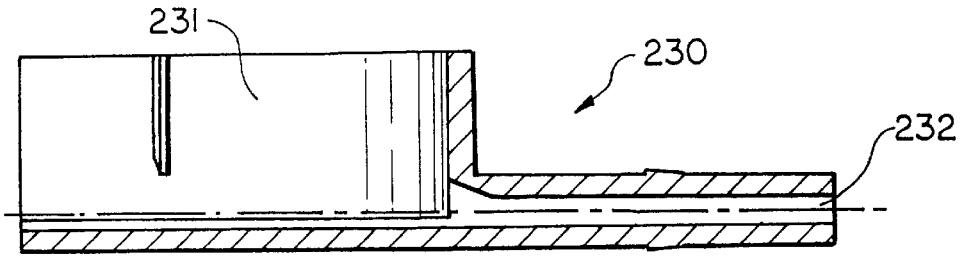
FIG. 15 is a cross-sectional side view of an insulator of the power inserter connector of FIG. 13.
Figure 15A:
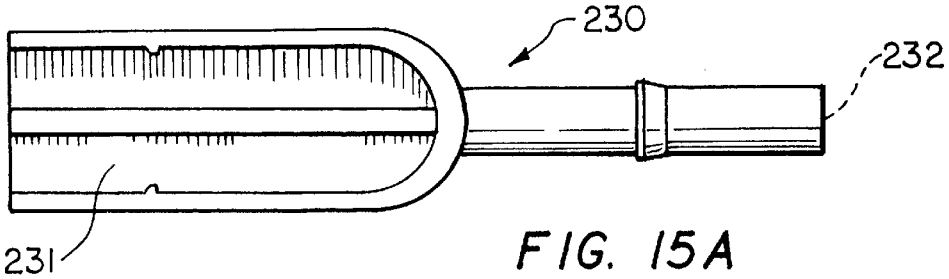
FIG. 15A is a top view of the insulator of FIG. 15.

FIGS. 15 and 15A show insulator 230. Insulator 230 is configured to fit within body 210. A first end of insulator 230 includes a cavity 231 which aligns within the body 210 to allow access to the terminal seizure mechanism within terminal 20. The insulator 230 isolates a section of the terminal 20 and the seizure mechanism from the body 210.

The power inserter connector 200 is assembled as follows. O-ring 80 is lubricated and installed adjacent the threaded section 211 of body 210. Insulator 230 is then installed within body 210. Terminal 20 is then inserted through insulator 230. Seizure screws 260 and 270 are installed into bore 261 and terminal 20 respectively.

The power inserter connector 200 is installed into the power inserter housing as follows. Anti-oxidant joint compound is applied to the threaded section 211 of body 210. The power inserter body 210 is installed onto the power inserter housing. Approximately ½ inch of cable jacket is removed from the conductors. If aluminum conductors are used, anti-oxidant joint compound should be applied to the exposed conductors. A conductor, typically the neutral conductor, is inserted into bore 214 of body 210. Seizure screw 60 is tightened, securing the conductor to the body 210. Another conductor, typically the hot conductor, is inserted into bore 24 of terminal 20. Seizure screw 70 is tightened, securing the hot conductor to the terminal 20. Heat shrink tubing or insulative tape is installed over the exposed end of the connector body 210.

The power inserter connector 200 is disconnected as follows. The heat shrink tubing or tape is removed. The seizure screws 60 and 70 are loosened and the conductors removed. The power inserter connector 200 is removed from the power inserter housing.

The power inserter connector of this embodiment includes a one piece body, a one piece insulator and a one piece terminal, all of which make the connector easier to manufacture and assemble as well as being lower in cost.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. A power inserter connector comprising:

an electrically conductive body open on each of a first end and a second end, said body having a central bore disposed therethrough, said first body end having a mounting surface;

an electrically conductive terminal having a first end and an elongated second end, said first terminal end including a first seizure mechanism comprising a central bore having a diameter greater than or equal to an AWG #14 conductor and a threaded bore for receiving a first seizure screw, said first seizure screw for securing a first power conductor sized between AWG #14 and AWG #2 and placed within said central bore of said first seizure mechanism;

an insulator for isolating said terminal from said body, said insulator mounted on said mounting surface of said first body end and configured to receive and secure said first terminal end, said insulator having a bore through which said elongated second terminal end extends; and a second seizure mechanism disposed within and in electrical contact with said first body end, said second seizure mechanism comprising a central bore having a diameter greater than or equal to an AWG #14 conductor and a threaded bore for receiving a second seizure screw, said second seizure screw for securing a second power conductor sized between AWG #14 and AWG #2 and placed within said central bore of said second seizure mechanism.

2. The power inserter connector of claim 1 wherein said elongated second terminal end is offset from said first terminal end to align said elongated second terminal end with said central bore of said body.

3. The power connector of claim 1 wherein said second seizure mechanism is formed intergrally with said body.

4. The power inserter connector of claim 1 further comprising a first o-ring disposed adjacent the first end of said body.

5. The power connector of claim 1 wherein said terminal is sized to handle approximately 90 volts.

6. The power connector of claim 1 wherein said terminal is sized to handle at least approximately 30 amperes.

7. The power inserter connector of claim 1 wherein said insulator element comprises a unitary insulator.

8. The power inserter connector of claim 1 wherein said insulator element comprises a front insulator and a rear insulator.

9. The power inserter connector of claim 1 wherein said body comprises corrosion resistant material.

10. The power inserter of claim 1 wherein said body comprises aluminum.

11. The power inserter connector of claim 1 wherein said terminal comprises conductive material.

12. The power inserter connector of claim 1 wherein said insulator element comprises insulative material.

13. The power inserter connector of claim 1 wherein said insulator element comprises nylon.

14. The power inserter connector of claim 1 wherein said insulator element comprises DELRIN.

15. The power inserter connector of claim 1 further including a sealing subassembly comprising:

a subassembly body having a first end and second end and having a central bore disposed therethrough, and wherein the first end thereof is mated with the first end of said body;

a subassembly insert having a first end and a second end and having a central bore disposed therethrough and wherein the first end thereof is mated with a second end of said subassembly body;

a seal having a central bore disposed therethrough configured to receive a plurality of conductors, disposed within the central bore of said subassembly insert and extending beyond the second end of said subassembly insert;

a sealing ring disposed adjacent the second end of said subassembly insert and said seal; and a sealing nut mated with the second end of said subassembly insert.

16. The power inserter connector of claim 15 further comprising a second o-ring disposed between said body and said subassembly body.

17. The power inserter connector of claim 15 wherein said subassembly body, said subassembly insert and said sealing ring comprise corrosion resistant material.

18. The power inserter connector of claim 15 wherein said subassembly body, said subassembly insert and said seal ring comprise aluminum.

19. The power inserter connector of claim 15 wherein said seal comprises waterproof material.

20. The power inserter connector of claim 15 wherein said seal comprises neoprene.

21. The power inserter connector of claim 15 wherein said sealing nut comprises corrosion resistant material.

22. The power inserter connector of claim 15 wherein said sealing nut comprises zinc.

23. The power inserter connector of claim 1 wherein said terminal comprises brass.

24. The power inserter connector of claim 23 wherein said terminal comprises tin plated brass.

25. The power inserter connector of claim 1 further comprising a second terminal attached to said body and including said second seizure mechanism.

26. The power inserter connector of claim 25 wherein said second terminal comprises conductive material.

27. The power inserter connector of claim 25 wherein said second terminal comprises aluminum.

28. The power inserter connector of claim 25 wherein said second terminal comprises tin plated aluminum.

* * * * *

UNITED STATES PATENT AND TRADEMARK OFFICE

CERTIFICATE OF CORRECTION

PATENT NO. : 6,039,609
APPLICATION NO. : 08/783398
DATED : March 21, 2000
INVENTOR(S) : Bruce C. Hauver, Sr. et al.

It is certified that error appears in the above-identified patent and that said Letters Patent is hereby corrected as shown below:

Column 7, claim 3, line 28, "power connector" should read --power inserter connector--.

Signed and Sealed this

Seventeenth Day of July, 2007

JON W. DUDAS
*Director of the United States Patent and Trademark Office*